United States Patent [19]

Brandenburg

[11] 4,162,858

[45] Jul. 31, 1979

[54] STYLUS PRINTER IMPACT ENERGY CONTROL

[75] Inventor: Klaus Brandenburg, Wehbach, Fed. Rep. of Germany

[73] Assignee: U.S. Philips Corporation, New York, N.Y.

[21] Appl. No.: 819,757

[22] Filed: Jul. 28, 1977

[30] Foreign Application Priority Data

Aug. 6, 1976 [DE] Fed. Rep. of Germany ..... 2635398

[51] Int. Cl.[2] ..... B41J 3/12

[52] U.S. Cl. ..... 400/124; 318/126; 361/152; 400/166; 101/93.03

[58] Field of Search ..... 101/93.02-93.05; 318/126; 361/152-154; 400/124, 157.3, 166, 167

[56] References Cited

U.S. PATENT DOCUMENTS

| | | | |
|---|---|---|---|
| 3,456,161 | 7/1969 | Soltis | 361/152 |
| 3,711,754 | 1/1973 | Nemoto | 318/126 |
| 3,789,272 | 1/1974 | Vollhardt | 361/154 |
| 3,904,938 | 9/1975 | Martin | 361/154 |
| 3,994,381 | 11/1976 | Hebert | 400/124 |

*Primary Examiner*—Paul T. Sewell

*Attorney, Agent, or Firm*—Robert S. Smith

[57] ABSTRACT

In a magnetically operated matrix printer a circuit makes a decision when a magnet is actuated. The decision is whether or not the relevant magnet has already been actuated during the printing of the previous column of the matrix character being printed. When it has not been actuated, it is actuated with a larger quantity of energy (longer pulse). Thus the operation of the printer is in "resonance" with the mechanical movements of the magnet armature.

1 Claim, 2 Drawing Figures

STYLUS PRINTER IMPACT ENERGY CONTROL

Figure 1:
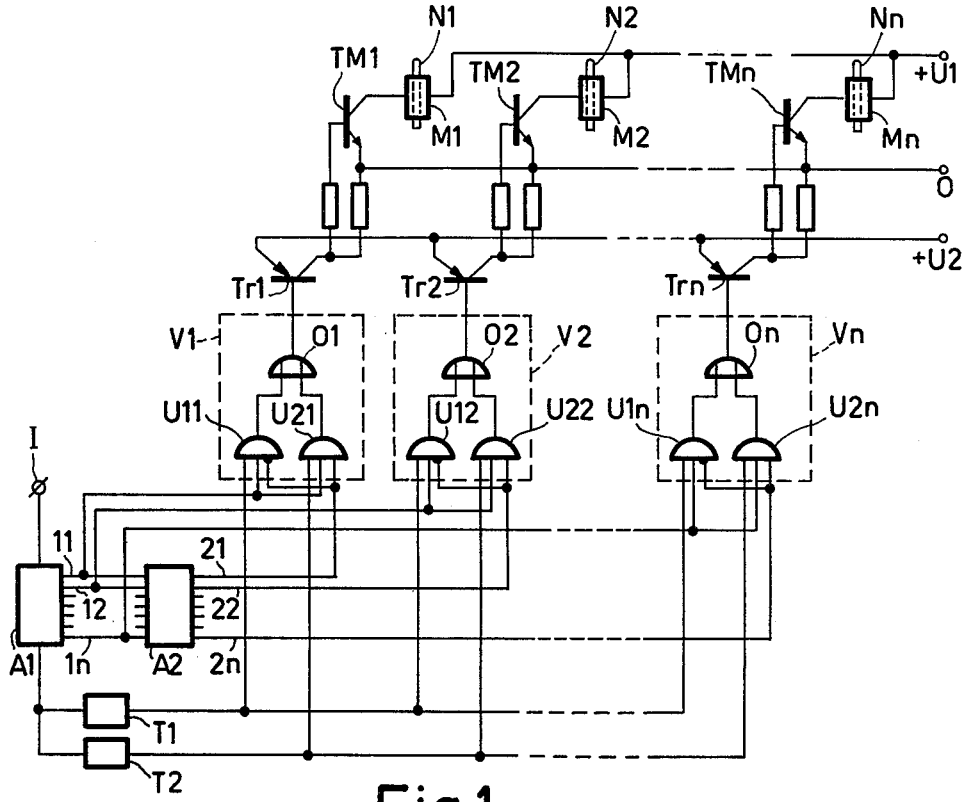

The invention relates to a stylus printer, comprising a number of printing styli which are arranged one underneath the other, each stylus being movable by an electromagnet so as to print a dot on a record carrier, the arrangement being such that a character to be printed can be built up in columns by selective actuation of the magnets in combination with a relative movement of the record carrier with respect to the printing styli, a magnet being actuated by one energy pulse or by a series of energy pulses, depending on the shape of the character to be printed.

During the printing of a matrix character, a printing head in which the printing styli are arranged in a row one underneath the other, is intermittently or continuously moved from one matrix column to the next matrix column. The character to be printed is then built up in columns. The printing styli are selectively actuated for this purpose. For example, for the printing of the character "A", the upper one of, for example, seven printing styli, being arranged one underneath the other, is actuated only once, the second stylus being actuated twice with a short interval, the third and the fourth stylus being each time actuated twice with a long interval, the fifth stylus being actuated five times in succession, and the sixth and the seventh stylus being moved only twice with one long interval by the associated magnet. Consequently, for the character "A" the magnets of the fifth printing stylus are energized by a series of pulses, whilst the other magnets are controlled by only single pulses. For other letters or digits, there are other combinations of pulse series and single pulses.

The repetition frequency at which the magnets are to be actuated constitutes a restrictive parameter for high printing speeds. For example, it is difficult to keep the masses to be moved small enough and to adhere at the same time to the conditions for an efficient electromechanical energy conversion. Therefore, matrix printers of this kind operate with short strokes and substantial development of heat in the coils. However, this is a drawback for the application of this printing principle.

It has already been attempted to eliminate these drawbacks by operating the printing magnets so that the actuation pulses and the movement are adjusted to resonance in the case of a continuous pulse series, i.e., it is attempted to attune the actuation in the time of the magnets for the printing of characters to the mechanical movements of the magnet systems. However, in practice this effect cannot be utilized, or only when a poor printing quality is accepted, because the actuation pulse series is discontinuous, depending on the character matrix.

The invention has for its object to attune the actuation and the mechanical properties of the magnets of a stylus printer to each other so that resonant operation is possible in the case of a continuous and approximately equidistant pulse series. To this end, the stylus printer in accordance with the invention is characterized in that for the selective actuation of the magnets there is provided a control circuit which is adapted to determine whether a magnet to be actuated has already been actuated during the printing of the directly preceding column, and to supply a magnet where this is the case with a pulse containing a quantity of energy which is smaller than that applied to a magnet where this is not the case.

It is to be noted that from German Patent specification no. 1,181,241 it is known that for typewriters or automatic printing devices comprising type levers it must be determined, prior to the printing of a complete character, whether the type lever to be operated is struck for the first time or repeatedly. However, this introduces a delay in order to force the type arm back to the starting position in the case of repeated striking.

However, in this case the energy supply cannot be influenced, so that no effect whatsoever can be exerted on the printing image of the character to be printed.

However, in the stylus printer in accordance with the invention an advantage is obtained in that for the same stroke of the styli operation at a higher speed or, for the same speed, operation with a longer stroke can be realised. It is also achieved that the mean quantity of electrical energy to be applied is smaller, because, due to the supply of the larger quantity of energy at the first pulse, the subsequent pulses are exactly in resonance with the mechanical movements of the stylus and hence require substantially less energy than in the known method.

One embodiment of the device in accordance with the invention will be described in detail hereinafter with reference to the accompanying diagrammatic drawing.

Figure 2:
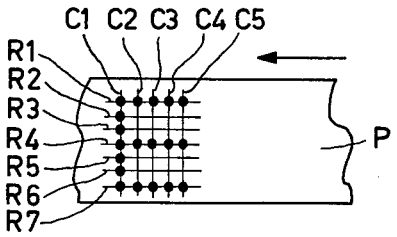

FIG. 1 diagrammatically shows the parts which are essential to the invention of an embodiment of a stylus printer in accordance with the invention, and FIG. 2 shows at an increased scale, a part of a record carrier with a character printed thereon.

As is known, the printing points required for the reproduction of the character in maxtrix printing are chosen from the total number of possible matrix points. In this embodiment, the character to be printed is built up of n columns, in that the magnets M1 to Mn of the associated printing styli N1 to Nn are separately actuated one after the other or in a sequence. For each column of the matrix print the corresponding pulse combination is applied (in a known manner not shown) to the input I of a first register A1. This register comprises outputs 11 to 1n which are connected to a second register A2 which receives, after the printing of a column, the contents of the first register A1, said register A2 having corresponding outputs 21 to 2n. The first register A1, moreover, is connected to two clock generators T1 and T2 so that both clock generators T1 and T2 are switched on as soon as one or more outputs 11 to 1n are actuated in the register A1. The clock generators T1 and T2 supply pulses having the same pulse repetition frequency, be it that they have a different pulse duration. The first clock generator T1 supplies pulses which are longer than those supplied by the second clock generator T2. Their ratio with respect to each other can be chosen at random and is determined by the pulse repetition frequency and by the geometrical and magnetic properties of the magnets.

The outputs of the registers A1 and A2 and the two clock generators T1 and T2 are followed by logic networks V1 to Vn, each of which is associated with a switching circuit of one of the printing magnets M1 to Mn. These logic networks V1 to Vn consist of the delta connection of each time two AND-gates U1i and U2i and one OR-gate Oi (i=1 to n). Each of the AND-gates comprises three inputs which, as is clearly shown in the drawing, are connected to the outputs of the registers A1 and A2 and to the outputs of the two clock generators T1 and T2. While the outputs 11 to 1n and 21 to 2n of the two registers A1 and A2 respectively, are each time connected to both associated AND-gates, each AND-gate is each time connected to only one of the two clock generators T1 and T2. Moreover, the outputs of the second register A2 are connected directly to the one AND-gate U2i to U2n and in inverted form to the input of the other AND-gate U11 to U1n.

Each logic network V1 to Vn has associated with it a transistor Tr1 to Trn, the emitter of which is connected to a voltage +U2, the collector being connected, via resistors, to a switching circuit of one of the magnets M1 to Mn. These switching circuits comprise switching transistors TM1 to TMn, which are capable of connecting the magnets M1 to Mn to a voltage U1 which is chosen so that it is sufficient to actuate the magnets.

When it is assumed that printing of characters takes place in accordance with a matrix of seven rows R1 to R7 and five columns C1 to C5 (see FIG. 2), seven magnets M1 to M7 are required. If, for example, the letter "E" is to be printed on the record carrier P, the input I of the first register A1 for the printing of the first column C1 receives a pulse combination which actuates all seven outputs 11 to 17 of the first register A1. Simultaneously, the clock generators T1 and T2 are switched on. Via the connection lines between the outputs 11 to 17 and the inputs of the corresponding AND-gates U11 to U17 and U21 to U27, these two AND-gates are each time prepared. Because the outputs 21 to 27 of the second register A2 are not actuated, the inputs of the AND-gates U21 to U27 connected to these outputs are not prepared; however, the corresponding inputs of the AND-gates U11 to U17 are prepared by the inversion.

Because the two clock generators T1 and T2 have the same pulse repetition frequency, pulses are simultaneously applied to the various AND-gates via the corresponding lines. However, only the AND-gates U11 to U17 which are connected to the first clock generator T1, supplying the longer pulses, are conductive for the duration of this pulse and switch, via the subsequent OR-gate O1 to O7, the transistors Tr1 to Tr7 and hence the magnets M1 to M7. Thus, for the printing of the first column C1 all magnets are actuated and the first column of the letter "E" is printed. For the sake of simplicity, the drawing shows only the first, the second and the last magnet with the corresponding circuits.

After termination of the pulse supplied by the first clock generator T1, the state prevailing on the outputs 11 to 17 of the first register A1 is transferred to the second register A2, so that instead of the outputs 11 to 17 the outputs 21 to 27 are actuated. When the combination of the second column C2 to be printed appears via the input I of the first register A1 (in this example, the first, the fourth and the seventh matrix point of the seven possible matrix points would be concerned), the outputs 11, 14 and 17 are actuated in the register A1.

At the same time, the clock generators T1 and T2 are actuated again.

The situation then arising for the outputs 11, 14 and 17 differs from that for the outputs 12, 13, 15 and 16. For the outputs 11, 14 and 17, the outputs 21, 24 and 27 of the second register A2 are at the same time also actuated, so that the AND-gates U21, U24 and U27 switch due to the inversion, while the AND-gates U11, U14 and U17 are blocked. Thus, via the associated OR-gates O1, O4 and O7, the subsequent transistors Tr1, Tr4 and Tr7 are switched by the second clock generator T2 which supplies the shorter pulse. As has already been described, the magnets M1, M4 and M7 are thus energised.

The outputs 12, 13, 15 and 16 of the first register A1 are not actuated, but the corresponding outputs 22, 23, 25 and 26 of the second register A2 are actuated. Thus, the inputs of the AND-gates U22, U23, U25 and U27 which are connected to the outputs 22, 23, 25 and 27 of the register A2 are prepared, but the inputs of the AND-gates U12, U13, U15 and U16 connected thereto are not prepared. (Because the outputs 12, 13, 15 and 16 of the first register A1 and hence those of the AND-gates U12, U13, U15 and U17 connected thereto are not actuated, the two AND-gates for the outputs 22, 23, 25 and 26 of the second register A2 remain inactive. The printing magnets M2, M3, M5 and M6 connected to these combination circuits are not energised. For the printing of the character "E", the same switching situation will prevail for the following columns C3 to C5, so that for all further matrix points each time only the short pulses supplied by the second clock generator T2 become effective.

It will be obvious from the foregoing description that a switching transistor Tri is connected to the second clock generator T2, supplying the short pulses, by the logic network Vi only if a voltage is present on the relevant output 1i of the first register A1 as well as on the relevant output 2i of the second register A2. However, if the output 1i of the first register A1 is actuated, but the associated output 2i of the second register A2 is not actuated, the associated switching transistor Tri is connected to the first clock generator T1 supplying the longer pulses. Connection of the transistor Tri to one of the clock generators T1 or T2, however, is not effected when only the associated output 2i of the second register A2 is actuated, but not the associated output 1i of the first register A1.

The circuit shown in the drawing is merely a diagrammatic example. The same effect can also be readily obtained by another switching device. For example, in that it is checked whether or not a given period of time has expired between two actuation pulses and that the actuation time is increased or reduced in dependence thereof. The supplied voltage U1 or the coil current can also be varied instead of the influencing of the actuation time of the magnets. Combinations of these variants are also possible.

What is claimed is:

1. A stylus printer, comprising a number of printing styli which are arranged one underneath the other, each stylus being movable by an electromagnet so as to print a dot on a record carrier, the arrangement being such that a character to be printed can be built up in columns by selective actuation of the magnets in combination with a relative movement of the record carrier with respect to the printing styli, a magnet being actuated by one energy pulse or by a series of energy pulses, depending on the shape of the character to be printed, further including means for the selective actuation of the magnets including means for control including means to determine whether a magnet to be actuated has already been actuated during the printing of the directly preceding column, and to supply a magnet where this is the case with a pulse containing a quantity of energy which is smaller than that applied to a magnet where this is not the case, said means for control including means to vary the energy of the pulses by variation of the pulse length, said means for control further including a clock generator which is capable of controlling a number of switches, each of which actuates one of the magnets when actuated, and also comprising a register which is adapted to store per column to be printed the data indicating which magnets are to be actuated and to supply a pulse from the clock generator to the relevant switches or not in dependence of these data, and further including two registers which are connected to each other so that each time after the printing of a column the contents of the first register are transferred to the second register, there being provided two clock generators which generate pulse series having the same frequency, the pulses of the first clock generator having a duration longer than those of the second clock generator, each output of the first register being connected, together with the corresponding output of the second register, via a logic network, to the associated switch, said means for control conducting a pulse from one of the clock generators when the first register indicates that the relevant stylus must print a dot, a pulse from the second clock generator being conducted when the second register indicates that the same stylus has also printed a dot during the printing of the previous column, a pulse from the first clock generator being conducted when this is not the case.

* * * * *